US006996974B2

(12) United States Patent
Anilovich et al.

(10) Patent No.: US 6,996,974 B2
(45) Date of Patent: Feb. 14, 2006

(54) FUEL CONTROL FAILURE DETECTION BASED ON POST $O_2$ SENSOR

(75) Inventors: Igor Anilovich, Walled Lake, MI (US); David N. Belton, Birmingham, MI (US); David A. Frank, Rochester Hills, MI (US); Ian J. Mac Ewen, White Lake, MI (US)

(73) Assignee: General Motors Corporation, Detroit, MI (US)

( * ) Notice: Subject to any disclaimer, the term of this patent is extended or adjusted under 35 U.S.C. 154(b) by 140 days.

(21) Appl. No.: 10/685,201

(22) Filed: Oct. 14, 2003

(65) Prior Publication Data

US 2005/0076634 A1 Apr. 14, 2005

(51) Int. Cl.
*F01N 3/00* (2006.01)

(52) U.S. Cl. ..... 60/285; 60/274; 60/276; 123/103; 123/109

(58) Field of Classification Search ..... 60/274, 60/276, 277, 285; 701/103, 109, 115
See application file for complete search history.

(56) References Cited

U.S. PATENT DOCUMENTS

| | | | | |
|---|---|---|---|---|
| 4,364,227 | A * | 12/1982 | Yoshida et al. | 60/276 |
| 5,255,512 | A * | 10/1993 | Hamburg et al. | 60/274 |
| 5,272,872 | A * | 12/1993 | Grutter et al. | 60/274 |
| 5,602,737 | A * | 2/1997 | Sindano et al. | 701/108 |
| 6,446,429 | B2 * | 9/2002 | Kobayashi et al. | 60/285 |
| 6,453,665 | B1 * | 9/2002 | Bower, Jr. et al. | 60/285 |
| 6,594,987 | B2 * | 7/2003 | Uranishi | 60/277 |

* cited by examiner

*Primary Examiner*—Binh Q. Tran
(74) *Attorney, Agent, or Firm*—Christopher DeVries

(57) ABSTRACT

An engine diagnostic system includes a catalytic converter and an outlet $O_2$ sensor. The outlet $O_2$ sensor generates an outlet signal that is based on an oxygen level of exhaust gases exiting the catalytic converter. A controller adjusts a secondary fuel trim based on the outlet signal. The controller indicates a fault status if the secondary fuel trim has achieved a fuel trim limit and the outlet signal is out of a diagnostic range.

28 Claims, 3 Drawing Sheets

FUEL CONTROL FAILURE DETECTION BASED ON POST $O_2$ SENSOR

FIELD OF THE INVENTION

The present invention relates to diagnostic systems for vehicles, and more particularly to a diagnostic system that detects engine air to fuel (A/F) ratio imbalance and exhaust leaks.

BACKGROUND OF THE INVENTION

During the combustion process, gasoline is oxidized and hydrogen (H) and carbon (C) combine with air. Various chemical compounds are formed including carbon dioxide ($CO_2$), water ($H_2O$), carbon monoxide (CO), nitrogen oxides ($NO_x$), unburned hydrocarbons (HC), sulfur oxides ($SO_x$), and other compounds.

Automobile exhaust systems include a catalytic converter that reduces emissions by chemically converting exhaust gas into carbon dioxide ($CO_2$), nitrogen (N), and water ($H_2O$). Exhaust gas oxygen ($O_2$) sensors generate signals indicating the oxygen content of the exhaust gas. One $O_2$ sensor monitors the oxygen level associated with the inlet of the catalytic converter.

The inlet $O_2$ sensor provides a primary feedback signal to the fuel system. The signal that is generated by inlet $O_2$ sensor is used to control the A/F ratio of the engine. Maintaining the A/F ratio at the chemically correct or stoichiometric A/F ratio improves the efficiency of the catalytic converter. A second or outlet $O_2$ sensor monitors oxygen levels of the exhaust gas that exits the catalytic converter. The outlet $O_2$ sensor provides a secondary feedback signal to the fuel system. An optimal control range of the outlet $O_2$ sensor signal is defined by emission performance. The fuel system shifts an offset or bias of the inlet $O_2$ sensor signal when the outlet $O_2$ sensor signal is outside of a predetermined control range.

A/F ratio imbalance within individual cylinders of an engine and exhaust leaks can lead to undesired exhaust emission performance. As a result, it is necessary for a diagnostic system to identify A/F imbalance or leak conditions.

SUMMARY OF THE INVENTION

Accordingly, the present invention provides an engine diagnostic system including a catalytic converter and an outlet $O_2$ sensor. The outlet $O_2$ sensor generates an outlet signal that is based on an oxygen level of exhaust gases exiting the catalytic converter. A controller adjusts a secondary fuel trim based on the outlet signal. The controller indicates a fault status if the secondary fuel trim has achieved a fuel trim limit and the outlet signal is out of a diagnostic range.

In one feature, the engine diagnostic system further includes an inlet sensor that generates an inlet signal based on an oxygen level of exhaust gases entering the catalytic converter. The inlet signal is biased based on the outlet signal.

In one feature, the secondary fuel trim has achieved the fuel trim limit when an inlet sensor bias has achieved a bias limit and the outlet signal is outside of a control range.

In another feature, the controller indicates a pass status if a secondary fuel trim is less than the fuel trim limit.

In still another feature, the controller indicates a pass status if the outlet signal is within said diagnostic range.

In another feature, a fault for a given sample is indicated if the secondary fuel trim has achieved the fuel trim limit and the outlet signal is out of the diagnostic range.

In yet another feature, the fault decision is confirmed if the secondary fuel trim has achieved the fuel trim limit and the outlet signal is out of the diagnostic range for a threshold period during a monitoring period.

In still another feature, the fault status is indicative of a cylinder air to fuel (A/F) ratio imbalance or an exhaust leak.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
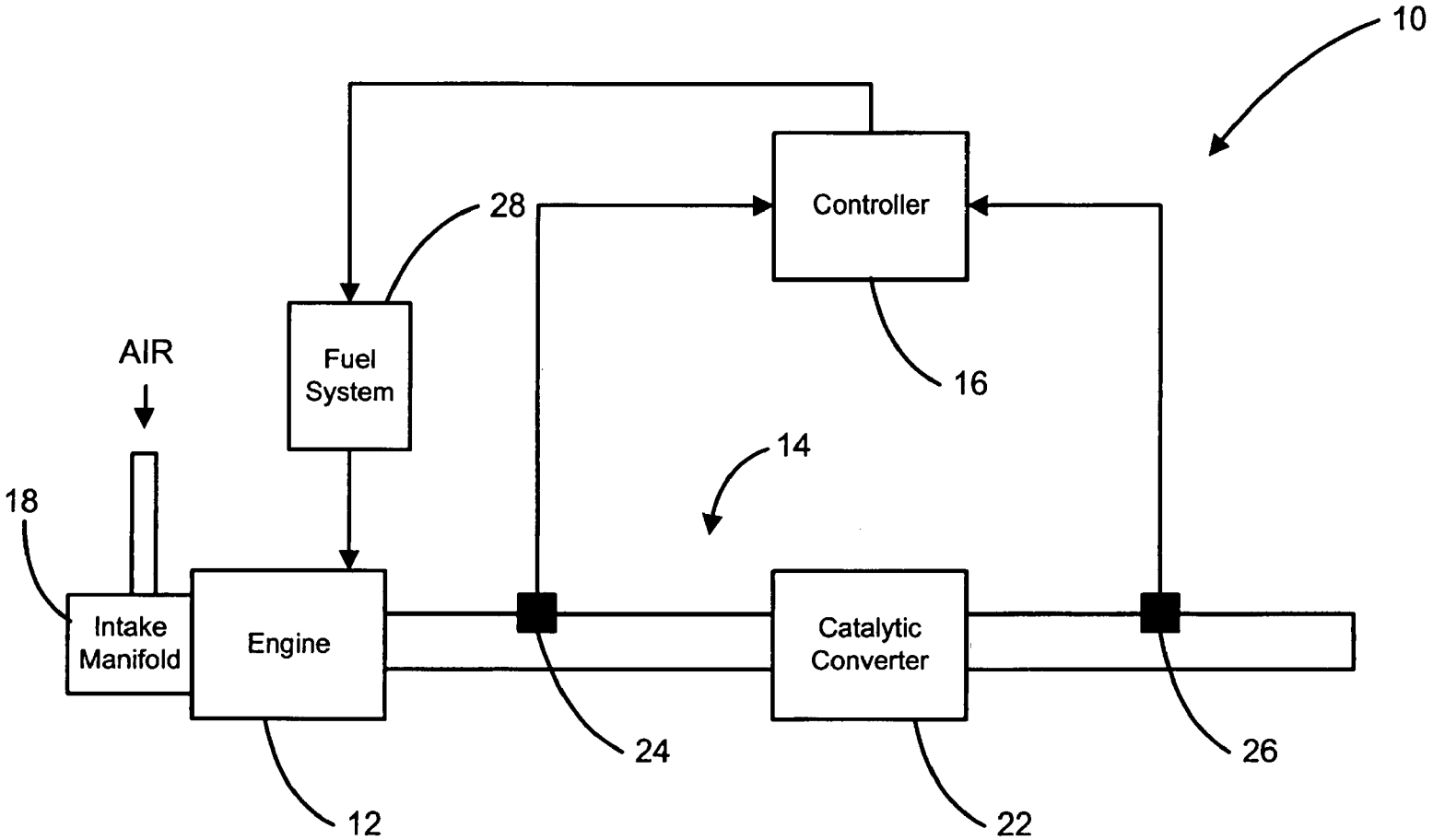
FIG. 1 is a functional block diagram of a vehicle including a controller that performs a secondary fuel trim diagnostic according to the present invention.

The following description of the preferred embodiments is merely exemplary in nature and is in no way intended to limit the invention, its application, or uses. For purposes of clarity, the same reference numbers will be used in the drawings to identify similar elements.

Referring now to FIG. 1, an engine system 10 includes an engine 12, an exhaust system 14 and a controller 16. Air is drawn into the engine through an intake manifold 18. The air is combusted with fuel inside cylinders of the engine 12. Exhaust gas produced by combustion exits the engine through the exhaust system 14. The exhaust system 14 includes a catalytic converter 22, a pre-catalyst or inlet $O_2$ sensor 24, and a post-catalyst or outlet $O_2$ sensor 26. The exhaust gas is treated in the catalytic converter 22 and then released to the atmosphere.

The inlet and outlet $O_2$ sensors 24 and 26 generate signals that are communicated to the controller 16. The inlet and outlet $O_2$ sensors 24, 26 provide inlet and outlet A/F ratio signals. The controller 16 communicates with a fuel system 28, which regulates fuel flow to the engine 12. In this manner, the controller 16 adjusts and controls the A/F ratio of the engine 12.

The inlet and outlet $O_2$ sensors 24,26 are typically narrow range switching sensors. It is appreciated, however, that the inlet and outlet $O_2$ sensors 24,26 are not limited to narrow range type switching sensors. Voltage output signals that are generated by the sensors 24,26 are based on the $O_2$ content of the exhaust gases passing the $O_2$ sensors relative to stoichiometry. The signals transition between lean and rich in a narrow A/F ratio range that brackets the stoichiometric A/F ratio. The $O_2$ sensor signal that is generated by an operable sensor oscillates back and forth between rich and lean values at a relatively constant frequency.

The controller 16 regulates the fuel flow based on the $O_2$ sensor signals. During primary fuel control, the controller 16 regulates fuel flow to the engine 12 based on the signal of the inlet $O_2$ sensor 26. For example, if the inlet $O_2$ sensor signal indicates a lean condition, the controller 16 increases fuel flow to the engine 12. Conversely, if the inlet $O_2$ sensor signal indicates a rich condition, the controller 16 decreases fuel flow to the engine 12.

The outlet $O_2$ sensor provides feedback that is used to adjust the inlet $O_2$ sensor. More particularly, the inlet $O_2$ sensor signal is adjusted by a bias or offset that is based on the outlet $O_2$ sensor signal. For example, if the outlet $O_2$ sensor 26 detects that the signal is outside of a control range, the controller 16 correspondingly adjusts the inlet $O_2$ sensor signal bias. It is desired to maintain the outlet $O_2$ sensor signal within a control range that corresponds to optimum emissions system performance. An exemplary control range is 600 mV to 700 mV. Thus, the influence of the outlet $O_2$ sensor 26 on the inlet $O_2$ sensor signal 24 is limited by a maximum offset or bias. In other words, the inlet $O_2$ sensor signal bias must be between upper and lower bias limits.

A diagnostic range for the outlet $O_2$ sensor signal is also provided. The diagnostic range is defined by upper and lower thresholds that exceed the respective thresholds of the control range. If the outlet $O_2$ sensor signal is outside of the diagnostic range, the diagnostic indicates an engine fault for that data sample. The engine fault could include an A/F ratio imbalance within a cylinder, an exhaust leak and/or other engine problems. The diagnostic range is determined using empirical data for engine configurations. For example, faulty engine conditions for the engine configuration are simulated. The outlet $O_2$ sensor signal is reviewed to determine the signal threshold between acceptable engine operation and faulty engine operation. The above-mentioned control range is within the diagnostic range.

Figure 2:
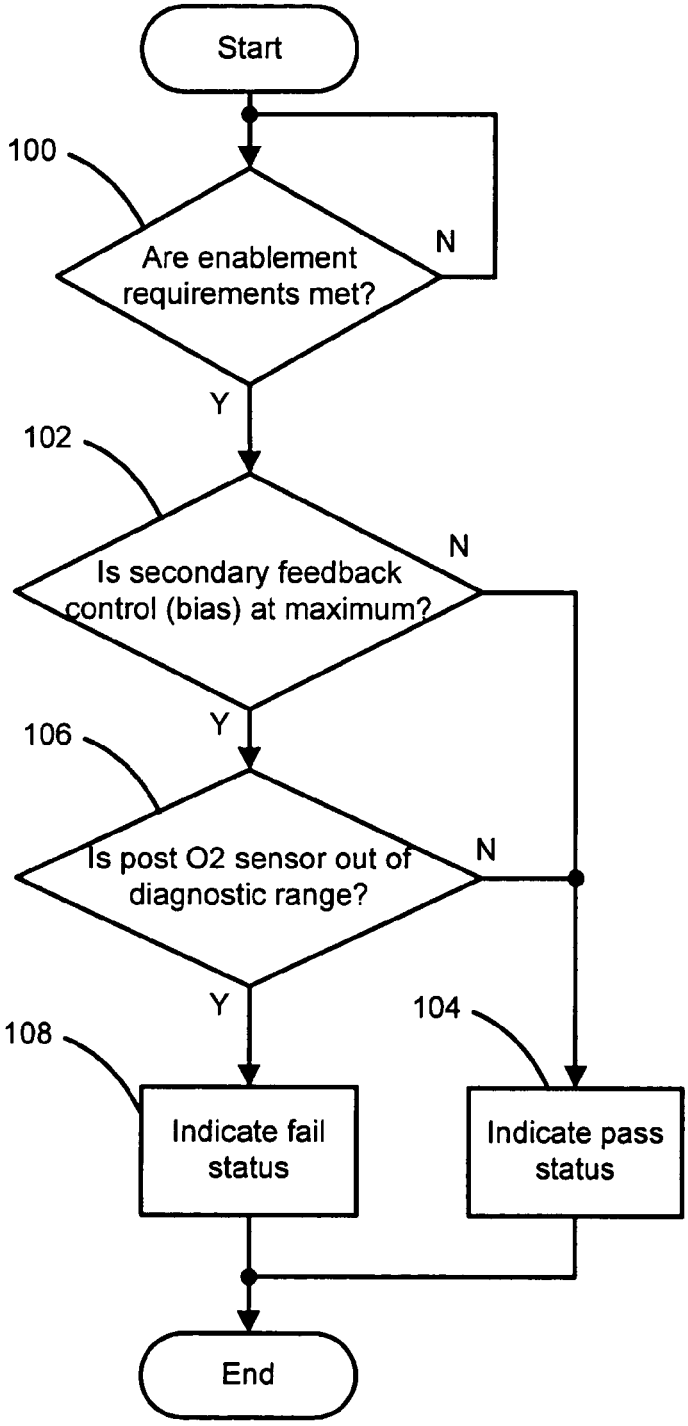
FIG. 2 is a flowchart detailing steps of the secondary fuel trim diagnostic according to the present invention.

Referring now to FIG. 2, the secondary fuel trim diagnostic will be described in detail. In step 100, control determines whether enablement requirements are met. If so, control continues in step 102. Otherwise control loops back. The enablement requirements include closed-loop fuel control, secondary fuel control and/or no intrusive diagnostics running. If the engine is operating in open-loop fuel control and/or secondary fuel control is disabled as a result of a vehicle event such as wide-open throttle acceleration, the secondary fuel control diagnostic is also not enabled. The secondary fuel control diagnostic is not enabled when system diagnostics that intrusively impact exhaust A/F ratio are running.

In step 102, control determines whether the secondary feedback control is at its maximum offset. This occurs when the outlet oxygen sensor signal is outside of the control range and the inlet oxygen sensor bias has achieved a bias limit. If the secondary feedback control is not at its maximum offset, a pass status is indicated in step 104 and control ends. Otherwise, control determines whether the outlet oxygen sensor signal is outside of the diagnostic range in step 106. If false, control continues in step 104. If true, control indicates a fail status in step 108 and ends.

Figure 3:
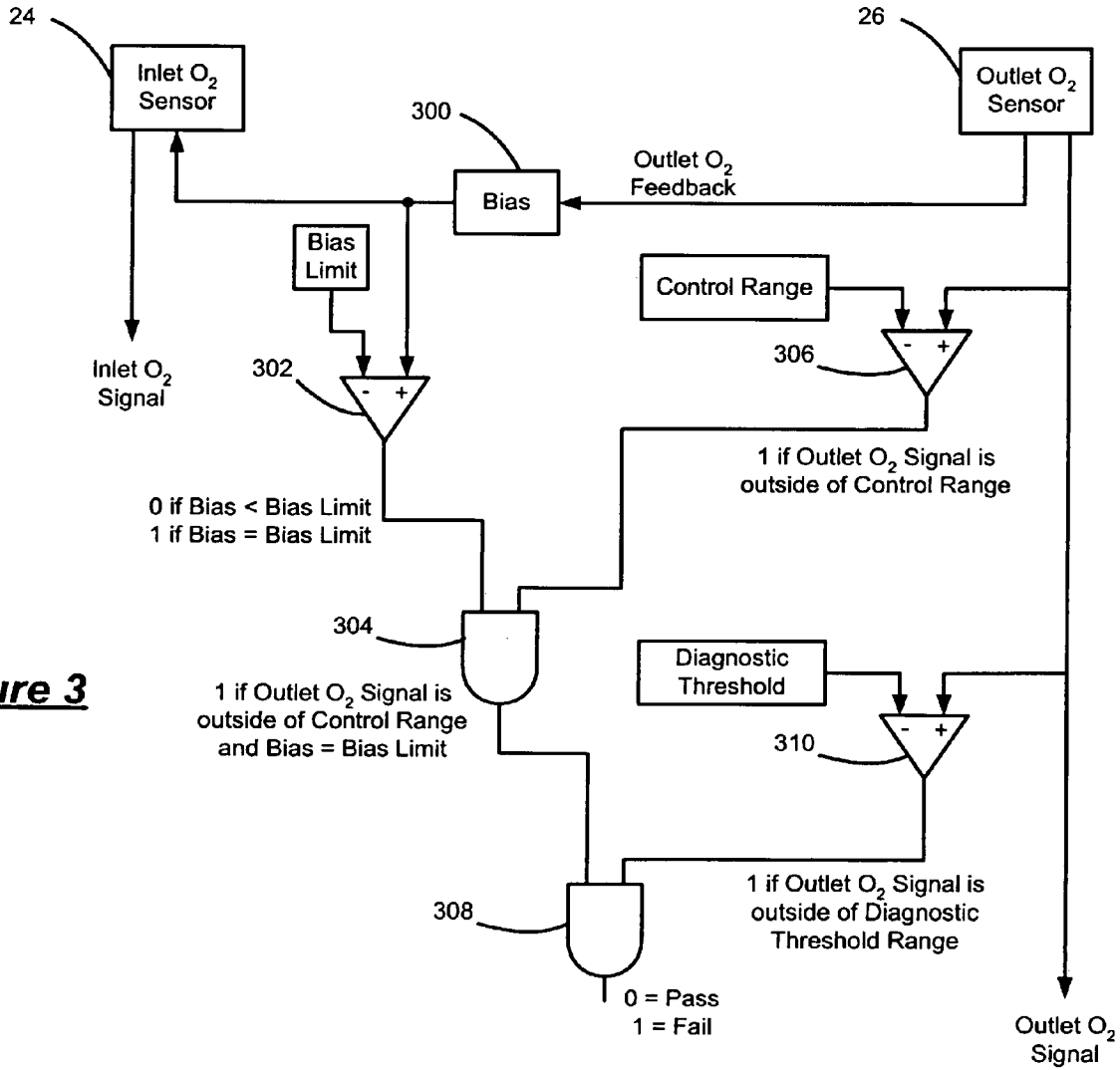
FIG. 3 is a signal flow diagram illustrating exemplary logic of the secondary fuel trim diagnostic.

Referring now to FIG. 3, a signal flow diagram illustrates exemplary logic of the secondary fuel trim diagnostic of the present invention. The inlet and outlet $O_2$ signals are sent to the controller 16. A feedback outlet $O_2$ sensor signal is sent to a bias circuit 300. The bias circuit 300 determines the offset or bias signal sent to the inlet sensor. The bias signal is limited to a maximum offset or bias limits. The bias signal is also sent to a first comparator circuit 302 that compares the bias signal to the bias limits. The output of the first comparator circuit 302 is sent to a first decision gate 304 and is 0 if the bias signal is inside the bias limit and is 1 if the bias signal is equal to a bias limit.

The outlet $O_2$ signal is sent to a second comparator 306. The second comparator compares the outlet $O_2$ signal to a control range. The output of the second comparator 306 is 1 if the outlet $O_2$ signal is outside of the control range. Otherwise, the output of the second comparator 306 is 0. The output of the second comparator is sent to the first decision gate 304. The output of the first decision gate 304 is 1 if the outputs of the first and second comparators are 1. That is to say, the output of the first decision gate 304 is 1 if the outlet $O_2$ signal is outside of the control range and the bias signal is equal to a bias limit. Otherwise, the output of the first decision gate 304 is 0. The output of the first decision gate 304 is sent to a second decision gate 308.

The outlet $O_2$ signal is also sent to a third comparator 310. The third comparator compares the outlet $O_2$ signal to the diagnostic thresholds. The output of the third comparator 310 is 1 if the outlet $O_2$ signal is outside of the diagnostic threshold range. Otherwise, the output of the third comparator 310 is 0. The output of the third comparator is sent to the second decision gate 308. The output of the second decision gate 308 is 1 if the outputs of the first decision gate 304 and the third comparator 310 are 1. That is to say, the output of the second decision gate 308 is 1 if the outlet $O_2$ signal is outside of the control range, the bias signal is equal to a bias limit and the outlet $O_2$ signal is outside of the diagnostic threshold range. Otherwise, the output of the second decision gate 308 is 0. An output of 0 indicates a pass and an output of 1 indicates a fail or fault.

The controller 16 can indicate a fault to the vehicle operator or flag the fault in memory immediately upon the occurrence of a fault and/or after a predetermined time status. The controller 16 can also perform the secondary fuel control diagnostic M times and flag a fault if the fail status occurs N out of M times, where $N \leqq M$. Another alternative embodiment flags a fault if the fail status occurs a threshold number of times during a predetermined period.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine diagnostic system, comprising:

a catalytic converter;

an outlet $O_2$ sensor that generates an outlet signal that is based on an oxygen level of exhaust gases exiting said catalytic converter; and a controller that adjusts a secondary fuel trim based on said outlet signal and that indicates a fault status if said secondary fuel trim is outside of a fuel trim limit range and said outlet signal is out of a diagnostic range.

2. The engine diagnostic system of claim 1 further comprising an inlet $O_2$ sensor that generates an inlet signal based on an oxygen level of exhaust gases entering said catalytic converter, wherein said inlet signal is biased based on said outlet signal.

3. The engine diagnostic system of claim 2 wherein said secondary fuel trim is outside of said fuel trim limit range when an inlet sensor bias has achieved a bias limit and said outlet signal is outside of a control range.

4. The engine diagnostic system of claim 1 wherein said controller indicates a pass status if a secondary fuel trim is within said fuel trim limit range.

5. The engine diagnostic system of claim 1 wherein said controller indicates a pass status if said outlet signal is within said diagnostic range.

6. The engine system of claim 1 wherein said fault for a given sample is indicated if said secondary fuel trim has achieved said fuel trim limit and said outlet signal is out of said diagnostic range.

7. The engine system of claim 1 wherein said fault decision is confirmed if said secondary fuel trim is outside of said fuel trim limit range and said outlet signal is out of said diagnostic range for a threshold period within a monitoring period.

8. The engine system of claim 1 wherein said fault status is indicative of one of a cylinder air to fuel (A/F) ratio imbalance and an exhaust leak.

9. An engine diagnostic system for an engine that produces exhaust that is treated by a catalytic converter and that includes an inlet $O_2$ sensor that generates an inlet $O_2$ signal and an outlet $O_2$ sensor that generates an outlet $O_2$ signal and a feedback signal to said inlet $O_2$ sensor comprising:

a first comparing circuit that compares an inlet $O_2$ sensor bias based on said feedback signal to a bias limit range;

a second comparing circuit that compares said outlet $O_2$ signal to a predetermined control range;

a third comparing circuit that compares said outlet $O_2$ signal to predetermined diagnostic thresholds; and a decision circuit that generates one of a pass status and a fail status for said engine based on outputs of said first, second and third comparing circuits.

10. The engine diagnostic system of claim 9, wherein said decision circuit generates said pass status when said inlet $O_2$ sensor bias is inside said bias limit range.

11. The engine diagnostic system of claim 9, wherein said decision circuit generates said pass status when said outlet $O_2$ sensor signal is within said control range.

12. The engine diagnostic system of claim 9, wherein said decision circuit generates said pass status when said outlet $O_2$ sensor signal is within said diagnostic threshold.

13. The engine diagnostic system of claim 9, wherein said decision circuit generates said fail status when said inlet $O_2$ sensor bias is within said bias limit range, said outlet $O_2$ sensor signal is outside of said control range and said outlet $O_2$ sensor signal is outside of said diagnostic threshold range.

14. A method of diagnosing engine system performance of an engine system including a catalyst with an inlet oxygen sensor and an outlet oxygen sensor, comprising:

monitoring a secondary fuel trim based on an outlet signal of said outlet oxygen sensor; and indicating a fault status if said secondary fuel trim outside of a fuel trim limit range and said outlet signal is out of a diagnostic range.

15. The method of claim 14 further comprising monitoring a bias of said inlet oxygen sensor.

16. The method of claim 15 wherein said secondary fuel trim has achieved said fuel trim limit when an inlet sensor bias is outside of said bias limit range and said outlet signal is out side of a control range.

17. The method of claim 14 further comprising indicating a pass status if said secondary fuel trim is within said fuel trim limit range.

18. The method of claim 14 further comprising indicating a pass status if said outlet signal is within said diagnostic range.

19. The method of claim 14 wherein said step of indicating a fault for a given sample comprises:

monitoring occurrences of said secondary fuel trim achieving said fuel trim limit and said outlet signal being out of said diagnostic range; and indicating said fault for a given sample if said number of occurrences is above a predetermined threshold.

20. The method of claim 14 wherein said step of confirming a fault decision comprises:

monitoring said secondary fuel trim and said outlet signal for a monitoring period; and confirming said fault decision if said secondary fuel trim has achieved said fuel trim limit and said outlet signal is out of said diagnostic range for a threshold period within said monitoring period.

21. The method of claim 14 wherein said fault status is indicative of one of a cylinder air to fuel (A/F) ratio imbalance and an exhaust leak.

22. A method of detecting one of a cylinder air to fuel (A/F) ratio imbalance and an exhaust leak of an engine system having a catalytic converter with an inlet oxygen sensor and an outlet oxygen sensor, comprising:

monitoring a secondary fuel trim based on an outlet signal of said outlet oxygen sensor;

monitoring a bias of said inlet oxygen sensor; and indicating a pass status if an inlet sensor bias is within the bias limits and said outlet signal is within a control range.

23. The method of claim 22 further comprising indicating a pass status if said outlet signal is out of a control range and within a diagnostic range.

24. The method of claim 22 further comprising indicating a fail status if a secondary fuel trim is outside of said fuel trim limits.

25. The method of claim 22 further comprising indicating a pass status if said outlet signal is within said diagnostic range.

26. The method of claim 22 wherein said step of indicating a fault for a given sample comprises:

monitoring occurrences of said secondary fuel trim achieving said fuel trim limit and said outlet signal being out of said diagnostic range; and indicating said fault for a given sample if said number of occurrences is above a predetermined threshold.

27. The method of claim 22 wherein said step of confirming a fault decision comprises:

monitoring said secondary fuel trim and said outlet signal for a monitoring period; and confirming said fault decision if said secondary fuel trim has achieved said fuel trim limit and said outlet signal is out of said diagnostic range for a threshold period within said monitoring period.

28. The method of claim 22 wherein said fault status is indicative of one of a cylinder air to fuel (A/F) ratio imbalance and an exhaust leak.

* * * * *